US007111753B2

(12) United States Patent
Scheetz, II et al.

(10) Patent No.: US 7,111,753 B2
(45) Date of Patent: Sep. 26, 2006

(54) INSULATING SLEEVE FOR A BEVERAGE CONTAINER

(76) Inventors: Thomas J. Scheetz, II, 310 E. Anderson St., Apartment B, Orlando, FL (US) 32801; Amy D. Downs, 3594 Ventura Club Cir., Orlando, FL (US) 32822

( * ) Notice: Subject to any disclaimer, the term of this patent is extended or adjusted under 35 U.S.C. 154(b) by 281 days.

(21) Appl. No.: 10/630,816

(22) Filed: Jul. 30, 2003

(65) Prior Publication Data

US 2004/0084460 A1 May 6, 2004

Related U.S. Application Data

(60) Provisional application No. 60/399,965, filed on Jul. 30, 2002.

(51) Int. Cl.
*B65D 25/34* (2006.01)

(52) U.S. Cl. ..... 220/903; 215/12.1

(58) Field of Classification Search ..... None
See application file for complete search history.

(56) References Cited

U.S. PATENT DOCUMENTS 4,248,366 A * 2/1981 Christiansen ..... 224/148.6
4,514,995 A * 5/1985 Curtis et al. ..... 66/170
5,862,937 A 1/1999 Carrizales et al.
6,026,983 A 2/2000 Graham
6,029,938 A 2/2000 Fava
D430,460 S 9/2000 Yu
D433,802 S 11/2000 Graham
D441,614 S 5/2001 Carroll
6,286,798 B1 9/2001 Chun
6,343,735 B1 2/2002 Cai
2001/0023595 A1 9/2001 Kaposi
2001/0027979 A1 10/2001 Canfield
2001/0032867 A1 10/2001 Silbert
2001/0040380 A1 11/2001 Forjone

* cited by examiner

*Primary Examiner*—Stephen Castellano
(74) *Attorney, Agent, or Firm*—John L. DeAngelis, Jr.; Beusse, Wolter, Sanks, Mora & Maire, P.A.

(57) ABSTRACT

A beverage container insulating sleeve for insulating a user's hand from a cold or hot beverage container while maintaining the serving temperature of the beverage. The material of the sleeve comprises insulating polyethylene foam. The sleeve is a low cost, lightweight, ergonomic, solution for consumers, advertisers, and anyone who sells hot or cold bottled beverages. The sleeve is further conformable to various beverage container styles and shapes due to a plurality of vertical slits formed therein.

12 Claims, 7 Drawing Sheets

INSULATING SLEEVE FOR A BEVERAGE CONTAINER

This patent application claims the benefit of the provisional patent application filed on Jul. 30, 2002, assigned application No. 60/399,965 and entitled, "Insulating Beverage Container Sleeve."

FIELD OF THE INVENTION

The present invention is directed generally to a sleeve for a container, and more specifically, to an insulating sleeve for a beverage container.

BACKGROUND OF THE INVENTION

Numerous varieties of thermal insulating sleeves are available for insulating beverage containers, such as cans and bottles for soft drinks and beer. These sleeves slide over the container to provide an insulating exterior surface, insulating the beverage container from ambient temperature and thus slowing the rate of heat flow between the ambient environment and the beverage and its container. These sleeves are available in an assortment of sizes for use with various container types, including but not limited to paper, plastic, glass, and aluminum beverage containers. Use of an insulating sleeve is advised for both hot and cold beverages.

Typically, the insulating sleeve is made from polyethylene foam, a material known for its thermal insulating properties. Tests conducted on beverages packaged in glass bottles prove the beneficial effects of the insulating sleeve. Two bottles where chilled and the temperature of the liquid contained therein was measured, one bottle having an insulating beverage sleeve and the other without. As expected, the liquid in the sleeve-insulated bottle retained a lower temperature for a considerably longer period than the uninsulated container. Temperature maintenance is important for maximum enjoyment of the beverage, whether it be a hot or a cold beverage.

Prior art sleeve insulators include foam and neoprene "koozies." Although suitable for insulating the beverage and its container, neither is intended to be disposable due to their relatively high manufacturing cost. The sleeves are typically purchased as a stand-alone item and must be transported by the consumer for use wherever cold or hot beverages are served. Since the prior art sleeves include a bottom surface, they are not easily folded nor collapsed, resulting in a somewhat bulky product that is not convenient to carry in a purse or pocket. The prior art sleeves are sized for a specific beverage container (e.g., beverage can, 12 ounce bottle) as they are designed and constructed for specific beverage containers and thus not conformable to other beverage containers.

BRIEF SUMMARY OF THE INVENTION

An insulating sleeve for a beverage container having a sidewall, comprises an expansible sleeve comprising first and second opposingly oriented openings and a passageway therebetween, wherein the sleeve defines a plurality of slits therein. A band region is disposed proximate the first opening, wherein the band region is substantially non-expansible. The beverage container is received within the passageway through the second opening, expanding the plurality of slits into an open position such that the sleeve conforms to the sidewalls of the container.

BRIEF DESCRIPTION OF THE DRAWINGS

The foregoing and other features of the present invention will be apparent from the following more particular description of the invention as illustrated in the accompanying drawings, in which like reference characters refer to the same parts throughout the different figures and text. The drawings are not necessarily to scale, emphasis instead being placed upon illustrating the principles of the invention.

DETAILED DESCRIPTION OF THE INVENTION

Figure 1:
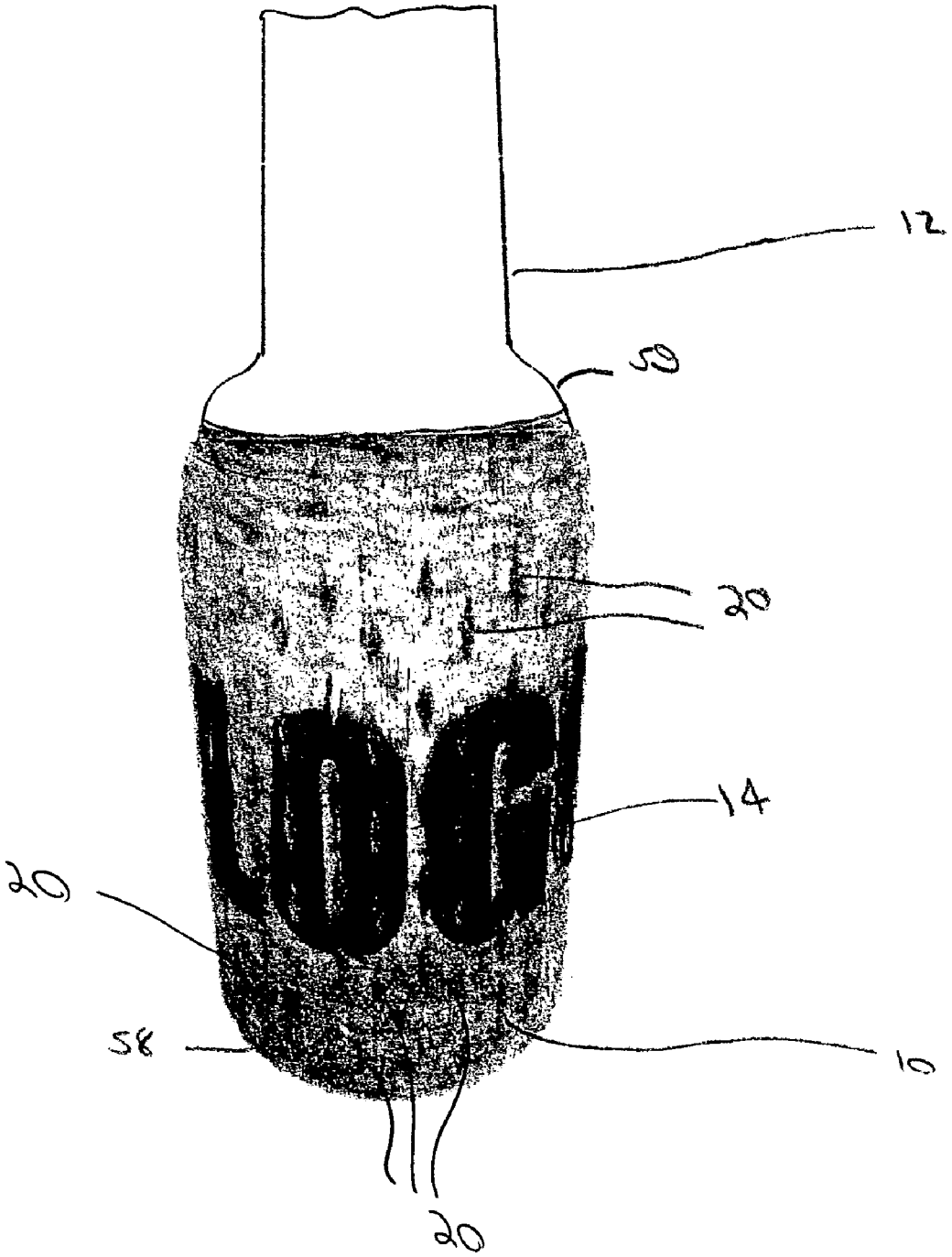
FIG. 1 illustrates an insulating sleeve constructed according to the teachings of the present invention wrapped around a beverage container.

Before describing in detail the particular beverage container sleeve in accordance with the present invention, it should be observed that the present invention resides in a novel and non-obvious combination of elements. Accordingly, the elements have been represented by conventional elements in the drawings, showing only those specific details that are pertinent to the present invention so as not to obscure the disclosure with details that will be readily apparent to those skilled in the art having the benefit of the description herein.

Most bars and restaurants chill beverages such as beer, specialty liquor drinks, bottled water, etc., either by placing said items in a refrigerated cooler or in a tub filled with ice. When a customer wraps her hand around the beverage container, it is typically very cold. Further, the temperature differential between the container and ambient, causes liquid to condense (referred to as sweating) on the container's external surface. Once in the ambient atmosphere, the beverage temperature warms and eventually reaches the ambient temperature. Over many years of observation, the inventors have observed consumers wrapping beverage napkins around these cold containers to soak up the condensation and to maintain a comfortable hand temperature by shielding their hand from the cold container.

A sleeve constructed according to the present invention insulates the user's hand from the cold temperature of the container and the liquid it contains. The consumer thus maintains a dry hand as the sleeve reduces the container sweating (due to the decreased temperature differential between the container and the ambient environment) and absorbs any condensation that does form on the container. Use of the napkin or other absorbing material is avoided and the consumer instead is presented with a comfortable, ergonomic and safe gripping surface for the container. Further, the sleeve insulates the beverage container from the ambient atmosphere, significantly lengthening the time interval for the beverage to reach the ambient temperature.

As illustrated in FIG. 1, an insulating sleeve 10 is wrapped about a bottle 12, which is representative of the various types and styles of beverage containers suitable for use with the insulating sleeve 10. An advertisement or other suitable message can be printed on the sleeve 10, as indicated by a reference character 14. Note that the sleeve 10 does not provide an insulating surface on the bottom of the bottle 12. However, this is not believed to be a disadvantageous, as the bottle's bottom surface is insulated by the surface on which the bottle 12 is resting and container sweating from the bottom surface is not problematic for the user.

In one embodiment the sleeve 10 is constructed from an insulating polyethylene foam material. In another embodiment the polyethylene material is about ⅛ inch thick. The polyethylene foam has a relatively high coefficient of friction, thus providing a secure gripping surface for the user and a good friction fit to the container.

In another embodiment of the invention, a thicker material can be used to form the sleeve 10 to provide additional insulating capacity. In still another embodiment, other known types of insulating foam can be used to form the sleeve 10. Advantageously these foams are environmentally friendly.

Figure 2:
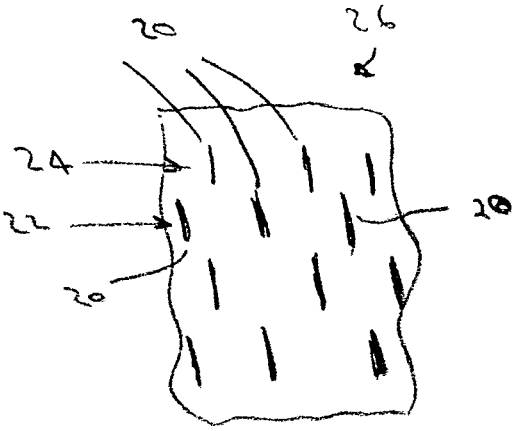
FIGS. 2 and 3 illustrate a close-up of a region of the sleeve of FIG. 1.

The sleeve 10 further comprises a plurality of substantially vertical incisions or slits 20 formed through the thickness of the sleeve material. FIG. 2 is a close-up view of a region 26 of the sleeve 10, illustrating the slits 20 in a closed position. The slits 20 can be positioned in various patterns relative to each other; the FIG. 2 embodiment illustrates the slits 20 in a staggered vertical pattern wherein a second row 22 of slits 20 is staggered between the slits 20 of a first row 24. The slits 20 permit the sleeve 10 to be expanded to the diameter of the beverage container, such as the bottle 12, with which it is to be slidably engaged. Further, the sleeve 10 is conformable to any size and shape beverage container by expansion of the slits 20. Thus a sleeve constructed according to the teachings of the present invention provides a "one size fits all" benefit. In different embodiments, the slits 20 are disposed along the entire sleeve length or disposed in only a portion of the sleeve length.

Figure 3:
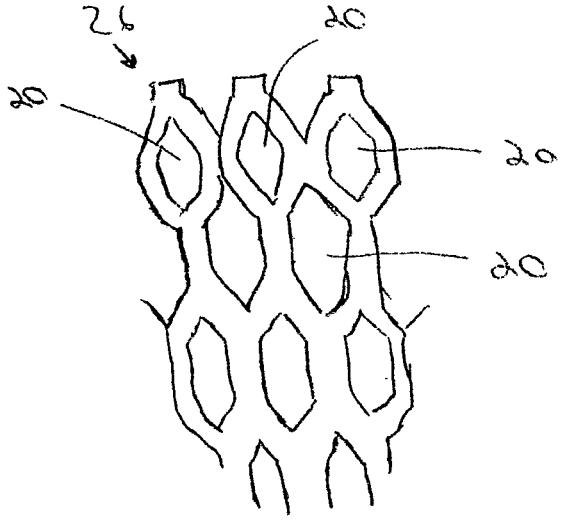

FIG. 3 illustrates a close-up view of the region 26, showing the slits 20 in an expanded or open position, as the sleeve 10 expands to wrap around any size or shape of beverage container. The slits 20 are shown in an open state in FIG. 1 where the sleeve 10 is wrapped around the bottle 12. Thus expansion of the slits 20 into the open state allow the sleeve 10 to conform to any container shape or size.

Figure 4:
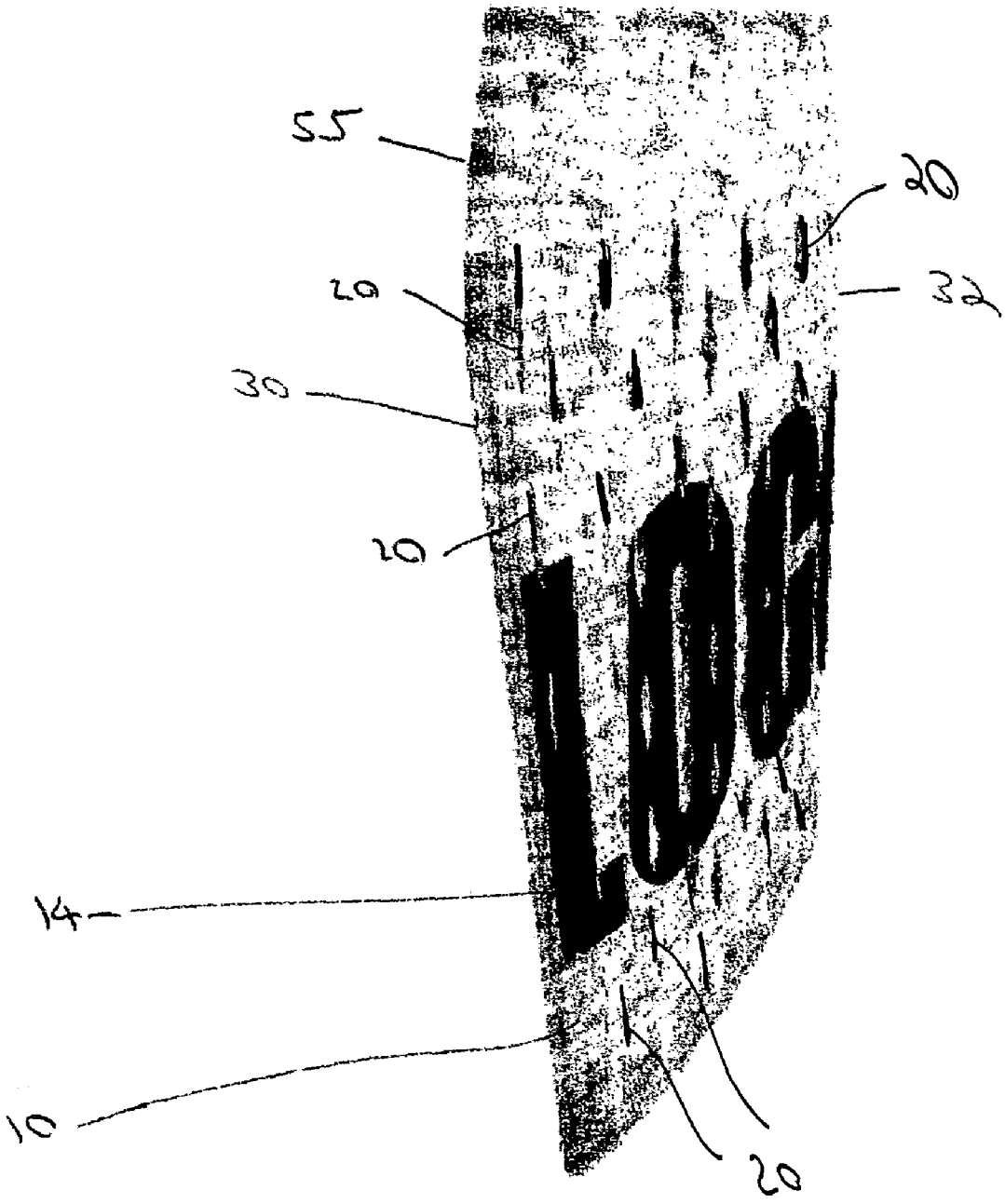
FIG. 4 illustrates the sleeve of Figure in a collapsed state.

FIG. 4 shows the sleeve 10 in a flat or collapsed state. To fit the sleeve 10 around a bottle or other beverage container, opposing edges 30 and 32 are compressed in a direction toward each other to form the sleeve 10 into a generally tubular shape. In FIG. 4, the slits 20 are in a generally closed state. In one embodiment, in the closed state the sleeve 10 is about six inches long by about three inches wide. The sleeve 10 can be expanded into a tubular shape having a circumference of about 13 inches. The length and open state diameter of the sleeve 10 can be selected depending on the size, height and shape of the beverage container with which it is to be used.

Figure 5:
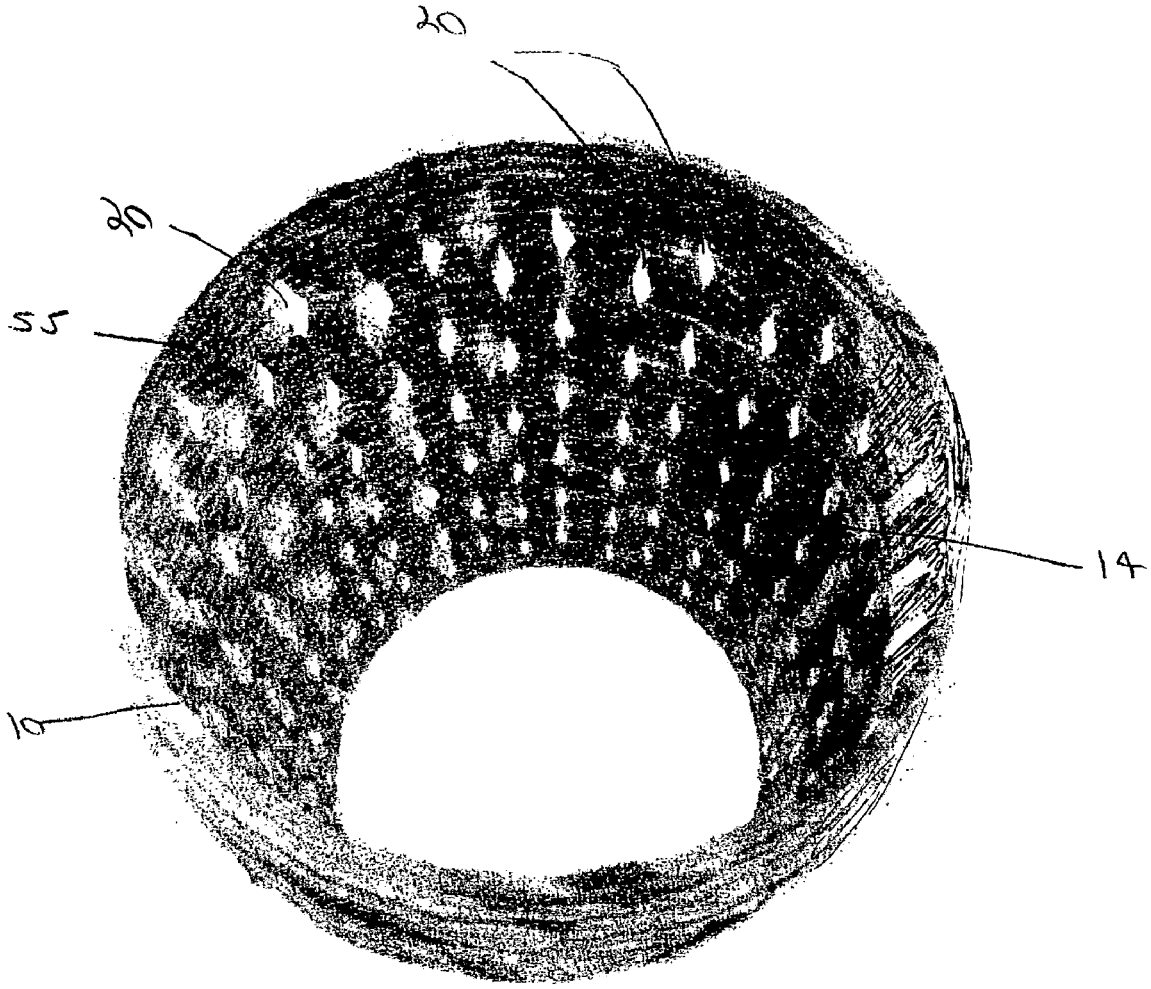
FIG. 5 is a top inside view of the sleeve of FIG. 1.

FIG. 5 is an inside top view of the sleeve 10 in an expanded state, illustrating the open slits 20 and the generally tubular shape of the sleeve 10, but without the bottle 12.

Figure 6:
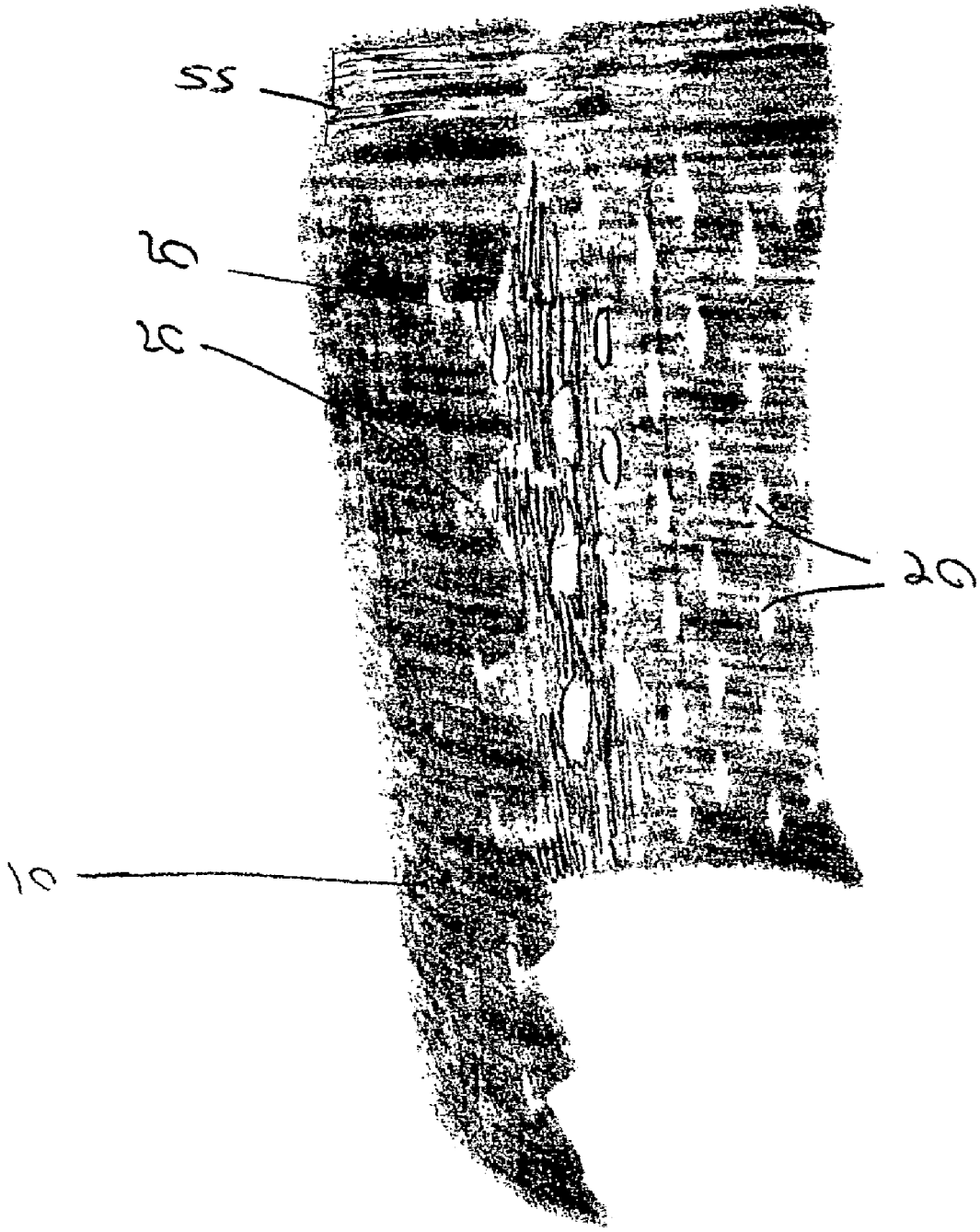
FIG. 6 is a cut away view of the sleeve of FIG. 1.

FIG. 6 is a cut-away inside view of the sleeve 10, illustrating the slits 20 in an expanded or open state.

Figure 7:
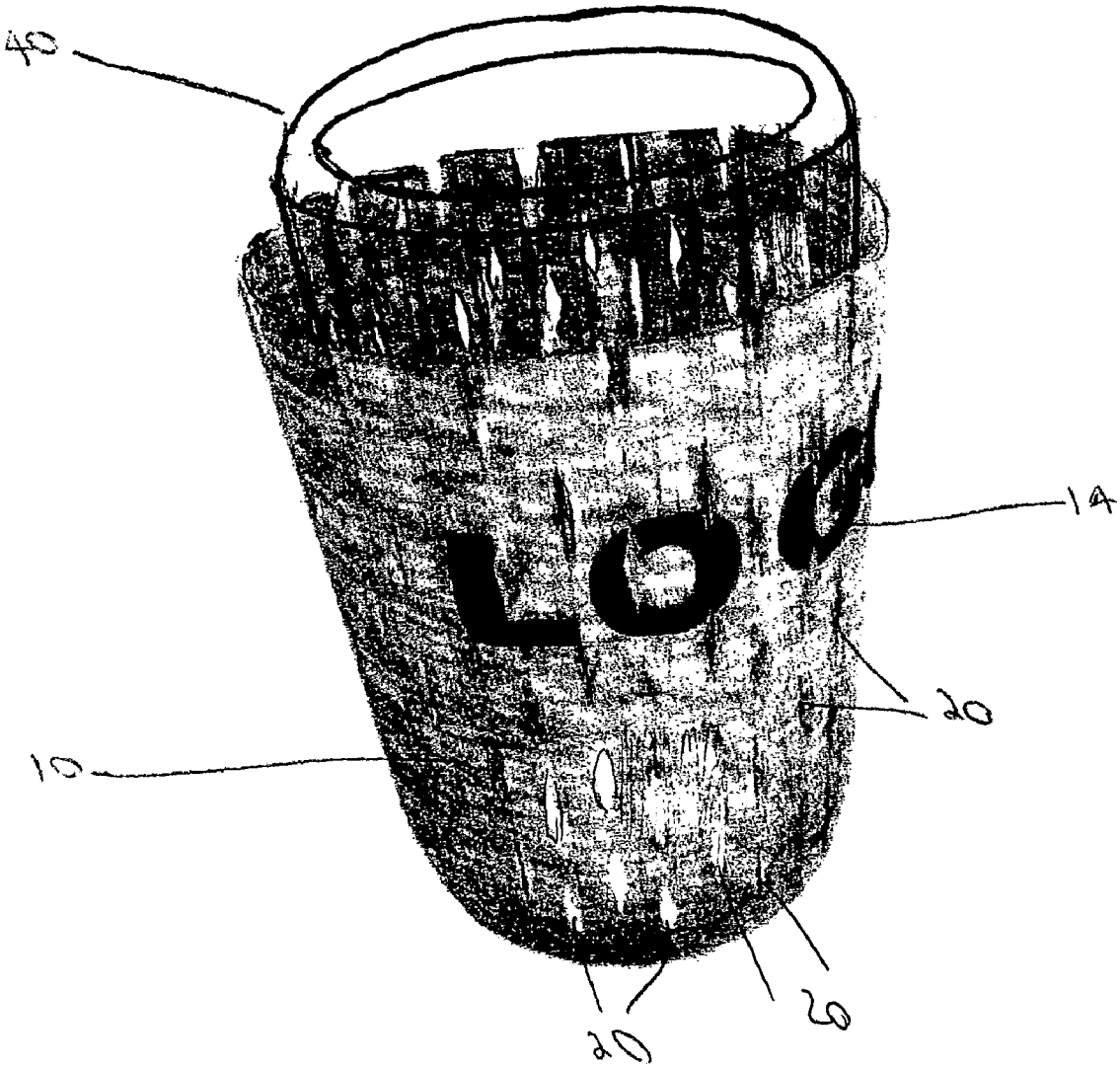
FIGS. 7 and 8 illustrate the sleeve of the present invention wrapped around variously styled beverage containers.

FIG. 7 illustrates the sleeve 10 in position about a soda beverage container 40.

Figure 8:
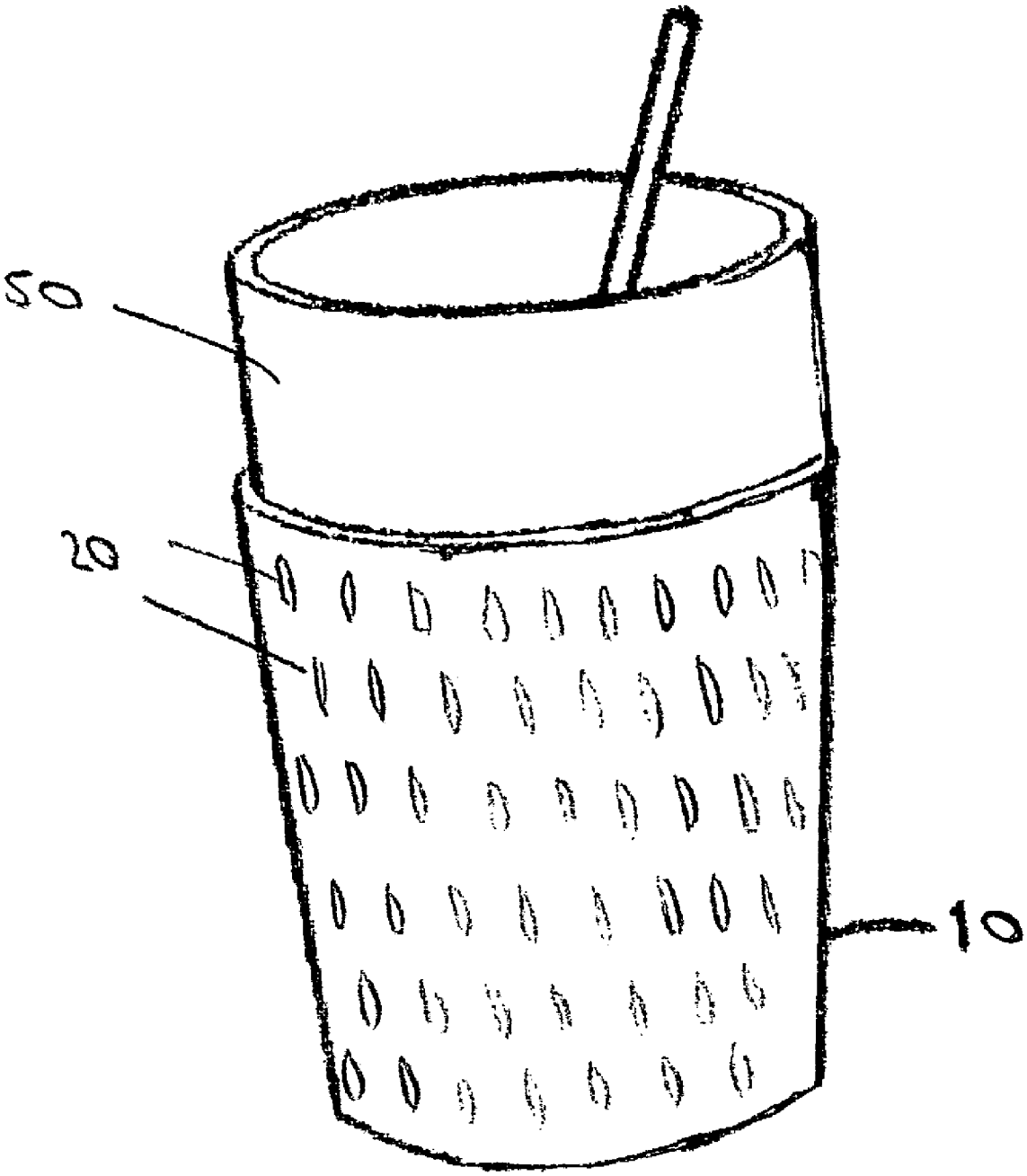

In addition to a tubular or substantially cylindrical shape, the sleeve 10 is capable of expanding to conform to a frustocomcal (i.e., a truncated circular cone) shaped container, such as a beverage container 50 illustrated in FIG. 8.

The sleeve 10 constructed according to the teachings of the present invention is considerably smaller, thinner, lighter and more compact than the prior art sleeves. Additionally, the sleeve 10 is disposable due to its relatively low manufacturing cost. One market segment where the benefits of the sleeve 10 are especially advantageous is the bar, restaurant, and hotel industry. Customers typically do not carry a prior art foam or neoprene "koozie" into a bar or restaurant because transporting the "koozie" is inconvenient and impractical. The sleeve 10, on the other hand, can be provided by a bar, restaurant, hotel, coffee stand, convenience store, etc. because it is far less expensive than competing products and is disposable. A customer may use the sleeve 10 while at the establishment and discard it before leaving. Alternatively, the user may keep the sleeve 10 for future reuse or as a memorabilia item. Given its collapsibility and minimum storage requirements, the sleeve 10 can easily be carried by a user. Thus the user will continue to be exposed to the advertising logo or message during each use.

In one embodiment the sleeve 10 further comprises a substantially non-expansible band or collar region 55 in which no slits are formed. See FIGS. 4–6. Typically, the sleeve is slidably engaged over the container top, and slid down over the container sidewalls until a sleeve lower edge 58 reaches the bottom of the container. See FIG. 1. In this position, the band region 55 prevents further downward motion of the sleeve 10 as the band constricts about a neck 59 of the container 12. Note that the band 55 is absent in the FIG. 8 embodiment.

Because of its thermal properties, the sleeve 10 can also be used as an insulating thermal wrap for containers of hot liquids, such as a cup of coffee, providing the same insulating features as when in use with cold beverage containers. In one embodiment, when the beverage container has an open mouth, the sleeve 10 slidably engages the hot beverage container at a bottom surface, as to engage from the top may result in spillage of the beverage. In fact, any open container can be slidably engaged with the sleeve 10 from the bottom. In one embodiment of a sleeve constructed according to the teachings of the present invention for slidable engagement from the bottom of a beverage container, the band 55 is not included.

Typically, the logo 14 is printed in up to four colors, offering an attractive and eye-catching advertising space. The ability to print at this high quality gives the sleeve 10 a beautiful look and is of great benefit to advertisers and consumers alike. The relatively low cost of the sleeve 10 provides affordable logo advertising space for both major and minor beverage manufacturers. The sleeve 10 can either be given away or sold at a minimal price by the advertiser. The low cost also allows advertisers to give sleeves to bar/restaurant patrons, such as, as a promotional give away item.

The sleeve 10 can also be used to cover the advertising logo on a beverage container. For example, if a bar patron is consuming brand X's beverage and brand Y is giving away or selling sleeves with their logo, a consumer will put the brand Y sleeve over the brand X container. The container is no longer a brand X container, but rather it has been transformed to a brand Y container with the addition of the sleeve 10. This transformation produces major advantages for advertisers.

In one embodiment, the sleeve 10 can be formed from material of various colors, providing additional variety and selection.

In the beverage manufacturing industry, a sleeve 10 can be included in a six pack or twelve pack of bottles or aluminum cans, printed with the manufacturer's logo or advertising message. The sleeve 10 can also be sold as a stand-alone item, such as in convenience stores or offered at beverage distribution machines.

One process for manufacturing the sleeve 10 includes printing the logo 14 on a film laminate that is then attached to the polyethylene foam. The foam, in the form of rolled material, is cut into individual strips and the slits formed also by cutting action. Individual sleeve blanks are perforated and the opposing edges of the blank are joined, typically by heat treating, to form the closed sleeve. Individual sleeves are separated from the roll at the perforations.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments set forth herein. In addition, modifications may be made to adapt a particular situation to the teachings of the present invention without departing from its essential scope. Therefore, it is intended that the invention not be limited to the particular embodiment disclosed as the best mode contemplated for carrying out this invention, but that the invention will include all embodiments falling within the scope of the appended claims.

What is claimed is:

1. An insulator for a container having sidewalls, comprising:

an expansible sleeve defining first and second opposingly oriented openings and a passageway therebetween, wherein the sleeve defines a plurality of expansible slits therein; and wherein the container is received within the passageway through the first or the second opening, expanding the plurality of slits into an open condition thereby expanding a diameter of the sleeve such that the sleeve conforms to the sidewalls of the container, and wherein the sleeve assumes a collapsed state when the container is not present in the passageway, and wherein in the collapsed state the slits are in a closed condition and the sleeve is deformable into a flattened configuration.

2. The insulator of claim 1 wherein the slits are vertically oriented when the sleeve is engaged over the container.

3. The insulator of claim 1 further comprising a band region encircling the first opening, wherein the band region is substantially non-expansible permitting the container to be received within the cylindrical member only through the second opening.

4. The insulator of claim 3 wherein no slits are formed in the band region.

5. The insulator of claim 3 wherein the container further comprises a neck region between a container region of a first diameter and a container region of a second diameter, and wherein the band region encircles the neck region.

6. The insulator of claim 1 wherein when the plurality of slits are expanded to the open condition, a diameter of the first opening is sufficient to insert the container.

7. The insulator of claim 1 wherein a sleeve length is less than a container height.

8. The insulator of claim 1 wherein a sleeve length is substantially similar to a container height.

9. The insulator of claim 1 further comprising printed material on a surface thereof.

10. The insulator of claim 1 wherein the plurality of slits are expandable such that containers of various sizes and shapes can be received within the passageway.

11. The insulator of claim 1 where the material of the sleeve comprises an insulating foam.

12. An insulator for a container having sidewalls, comprising:

an expansible sleeve defining first and second opposing openings and a passageway therebetween, a material of the sleeve defines a plurality of expansible slits therein; and a substantially non-expansible band region at the first opening;

wherein a narrower region of the container is received within the passageway through the second opening, expanding the plurality of slits into an open condition such that the sleeve conforms to the sidewalls of the container, wherein insertion of the container into the sleeve continues until the band region exerts an inwardly directed force on the sidewall that prevents further insertion and wherein the sleeve assumes a collapsed state when the container is not present in the passageway, and wherein in the collapsed state the slits are in a closed condition and the sleeve is deformable into a flattened configuration.

* * * * *